US008152534B1

(12) United States Patent
Li et al.

(10) Patent No.: US 8,152,534 B1
(45) Date of Patent: Apr. 10, 2012

(54) CONNECTOR USED FOR CONNECTING A COAXIAL CABLE AND A MICROSTRIP

(75) Inventors: Eric S. Li, Taipei (TW); Jui-Ching Cheng, Taipei (TW); Wei-Yu Tai, Kaohsiung (TW)

(73) Assignee: National Taipei University of Technology (TW)

( * ) Notice: Subject to any disclaimer, the term of this patent is extended or adjusted under 35 U.S.C. 154(b) by 0 days.

(21) Appl. No.: 13/096,273

(22) Filed: Apr. 28, 2011

(30) Foreign Application Priority Data

Oct. 8, 2010 (TW) ..... 99134360 A

(51) Int. Cl.
*H01R 12/00* (2006.01)

(52) U.S. Cl. ..... 439/63

(58) Field of Classification Search ..... 439/63, 439/581, 578
See application file for complete search history.

(56) References Cited

U.S. PATENT DOCUMENTS

| | | | | |
|---|---|---|---|---|
| 3,539,966 | A * | 11/1970 | Logan | 439/63 |
| 5,897,384 | A * | 4/1999 | Hosler, Sr. | 439/63 |
| 6,238,218 | B1 * | 5/2001 | Baffert | 439/63 |
| 6,457,979 | B1 * | 10/2002 | Dove et al. | 439/63 |
| 7,344,381 | B2 * | 3/2008 | Kerekes | 439/63 |
| 7,500,855 | B2 * | 3/2009 | Kari | 439/63 |
| 7,887,335 | B2 * | 2/2011 | Morley | 439/63 |
| 7,946,854 | B2 * | 5/2011 | Weidner et al. | 439/63 |
| 7,980,893 | B2 * | 7/2011 | Sato et al. | 439/578 |
| 8,035,466 | B2 * | 10/2011 | Payne | 333/260 |
| 2004/0038587 | A1 * | 2/2004 | Yeung et al. | 439/581 |
| 2004/0171301 | A1 * | 9/2004 | Jonsson et al. | 439/581 |
| 2005/0245110 | A1 * | 11/2005 | Kerekes | 439/79 |
| 2008/0102654 | A1 * | 5/2008 | Kari | 439/63 |
| 2010/0176896 | A1 * | 7/2010 | Payne | 333/33 |

* cited by examiner

*Primary Examiner* — Tulsidas C Patel
*Assistant Examiner* — Vladimir Imas
(74) *Attorney, Agent, or Firm* — Schmeiser, Olsen & Watts, LLP

(57) ABSTRACT

A connector comprises a coaxial connector and two metallic blocks. The coaxial connector has an outer conductor, a dielectric material, a mounting wall, and a center conductor. The space between the two conductors of the coaxial connector is filled with the dielectric material. The center conductor is extended from the inside of the coaxial connector to the other side of the mounting wall. The two metallic blocks are split from a metallic plate with a circular through hole in the center by milling across the plate at a proper position. Both metallic blocks are attached to the mounting wall of the coaxial connector with the extended center conductor placed in the center of the original through hole and surrounded by the recesses of the two blocks. Hence, the connector improves the transmission passband of a transition between a coaxial cable and a microstrip line at high frequencies.

19 Claims, 5 Drawing Sheets

CONNECTOR USED FOR CONNECTING A COAXIAL CABLE AND A MICROSTRIP

CROSS-REFERENCE TO RELATED APPLICATION

This non-provisional application claims priority under 35 U.S.C. §119(a) on Patent Application No(s). 099134360 filed in Taiwan, R.O.C. on Oct. 8, 2010, the entire contents of which are hereby incorporated by reference.

FIELD OF TECHNOLOGY

The present invention relates to a connector, in particular to a connector having two metallic blocks split from a metallic plate with a through hole in the middle to improve the transmission passband of a transition between a coaxial cable and a microstrip line.

BACKGROUND

As electronics and information technologies advance rapidly, various communication and information products have been developed to meet daily requirements. For communication products, flange-mount SMA connectors are extensively used in the input/output ports of high-frequency components all over the world, and employed in the transitions between coaxial cables and planar transmission lines to facilitate the testing of the circuits assembled on the planar transmission lines.

Another application is related to system integration, which requires interconnections between different transmission lines, such as interconnections between a coaxial cable and a microstrip line, a coaxial cable and a coplanar waveguide, a coaxial cable and a waveguide, and a waveguide and a microstrip line. Among them, the interconnection between a coaxial cable and a microstrip line is the most common transition. To achieve successful signal transmission between these two transmission lines with minimum insertion loss, designs of their transitions become very important.

With reference to FIGS. 1A and 1B for the schematic views of a conventional flange-mount SMA connector and a transition between a coaxial cable and a microstrip line using this connector, respectively, the conventional flange-mount SMA connector 100 is a coaxial connector, which comprises an outer conductor 111, a mounting wall 120, a center conductor 130, and a dielectric material 122. The transition is mainly used for high-frequency testing setups or the input/output ports of high-frequency devices for signal transmission between a coaxial cable (not shown in the figure) and a microstrip line 140. In the design for the conventional transition, the center conductor 130 of the conventional flange-mount SMA connector 100 is connected to a signal line 142 on the substrate 143 of a microstrip line 140, and then the outer conductor 111, the mounting wall 120, and the ground plane 141 underneath the substrate 143 of the microstrip line 140 are electrically connected to achieve signal transmission between the two transmission lines.

With reference to FIGS. 2A and 2B for the electromagnetic field distributions in a coaxial cable and a microstrip line, respectively, their electromagnetic field distributions are different, which introduces insertion loss at the transition of these two transmission lines, and it becomes more severe as frequency increases. Thus, the 1-dB passband of the conventional transition is limited.

Therefore, the goal of the present invention is to provide a connector to reduce the insertion loss caused by the change of the electromagnetic field distributions of the two transmission lines at their transition.

SUMMARY

In view of the disadvantages of the prior art, the inventors of the present invention, based on years of experience related to this product, conducted extensive research and experiments, and finally developed a connector with two metallic blocks separated from each other and attached to its mounting wall in an attempt to reduce the insertion loss caused by the change of the electromagnetic field distributions of the two transmission lines at their transition.

The primary goal of the present invention is to provide a connector with two metallic blocks separated from each other and attached to its mounting wall. The two metallic blocks are created by milling across a metallic plate with a circular through hole in the middle and are capable of reducing the insertion loss caused by the change of the electromagnetic field distributions of the two transmission lines at their transition. Thus, the 1-dB passband of the transition between a coaxial cable and a microstrip line is improved.

To achieve the aforementioned goal, the present invention provides a connector to connect a coaxial cable and a microstrip line. The microstrip line has a signal line, a substrate, and a ground plane. The signal line is on one side of the substrate and the ground plane is on the other side. The ground plane of the microstrip line within the connector is removed. Two via arrays are embedded into the inserted substrate between the two metallic blocks and are placed parallel and symmetrical to the signal line. The connector has two parts, a coaxial connector and two metallic blocks. The coaxial connector has an outer conductor, a dielectric material, a mounting wall, and a center conductor. The space between the outer and center conductors is filled with dielectric material. The center conductor is extended from the inside of the coaxial connector to the other side of the mounting wall. The two metallic blocks are created by milling properly across a metallic plate with a circular through hole in the center. A first metallic block, with a first recess being a portion of the through hole and located in the middle of a first inner side of this block as shown in FIG. 3A, is attached to the mounting wall. A second metallic block, with a second recess being a different portion of the same through hole and located in the middle of a second inner side of this block as shown in FIG. 3A, is attached to the mounting wall. The first inner side is separated from the second inner side by a certain distance and the first recess is placed face-to-face to the second recess. The extended center conductor of the coaxial connector is placed between the first recess and the second recess and located at the center of the original through hole as depicted in FIG. 3B. The coaxial connector is used to connect the coaxial cable. The ground plane of the inserted microstrip line between the first inner side and the second inner side is removed. The two via arrays are embedded into the substrate between the first inner side and the second inner side. The center conductor is in direct contact with the signal line of the microstrip line. The outer conductor, the mounting wall, the first metallic block, and the second metallic block are electrically connected to the ground plane of the microstrip line.

Therefore, the connector of the present invention can improve the frequency responses of a transition between a coaxial cable and a microstrip line at high frequencies.

DETAILED DESCRIPTION

To fully understand the objects, characteristics, and functions of the present invention, a preferred embodiment given below is combined with illustrated figures to provide detailed descriptions as follows.

Figure 3A:
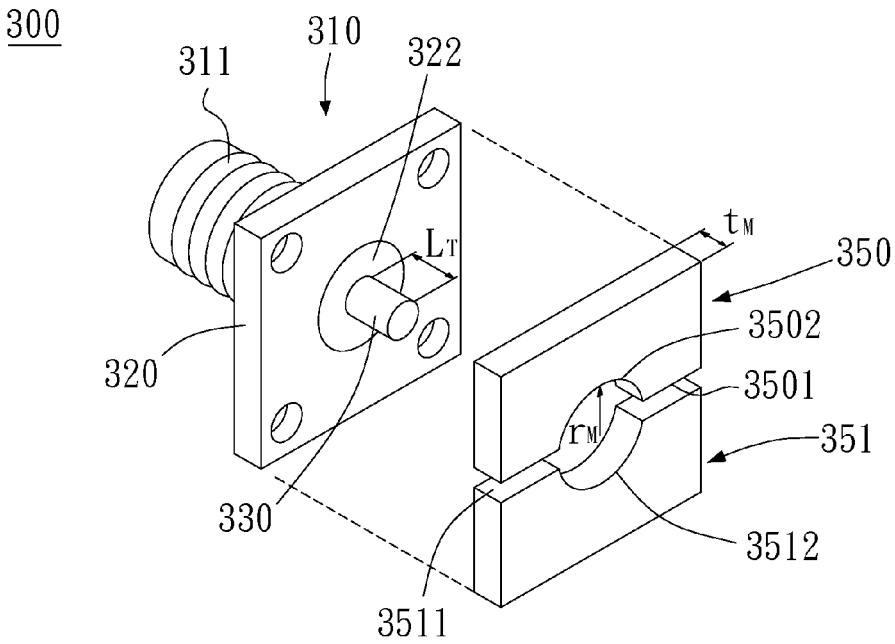
FIG. 3A is the schematic decomposed view of a preferred embodiment of the present invention.
Figure 3B:
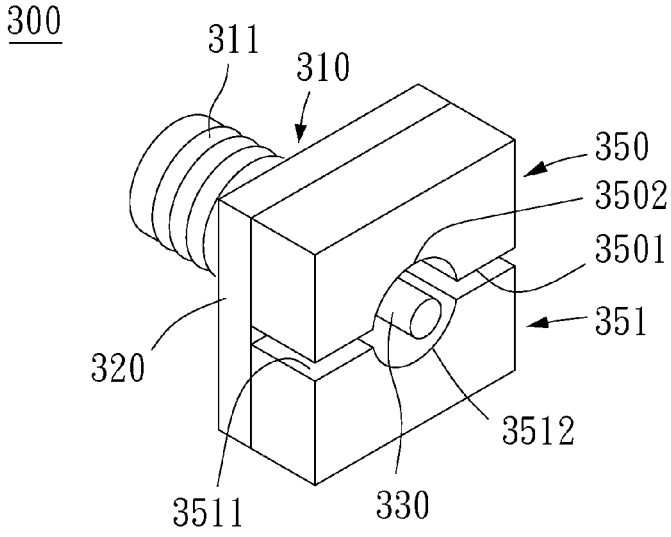
FIG. 3B is the schematic assembled view of a preferred embodiment of the present invention.

With reference to FIGS. 3A to 3D for the schematic decomposed view and the schematic assembled view of a preferred embodiment of the present invention, the schematic view of a transition between a coaxial cable and a microstrip line using the preferred embodiment of the present invention, and the schematic perspective view of a microstrip line to be connected with the preferred embodiment of the present invention, respectively, the connector 300 of the present invention is employed to connect a coaxial cable (not shown in the figure) and a microstrip line 340. The microstrip line 340 has a signal line 342, a substrate 343, and a ground plane 341. The signal line 342 is on one side of the substrate 343, and the ground plane 341 is on the other side. The ground plane 341 of the microstrip line 340 within the connector 300 is removed. Two parallel via arrays 344 are embedded into the substrate 343 inserted between the two metallic blocks 350, 351 and are placed parallel and symmetrical to the signal line 342. The periodical structure of the via arrays 344 can function as conductive walls to prevent energy within the via arrays 344 leaking sideward. The via arrays 344 have multiple via holes 3441. The diameter of the via holes 3441 can be 0.508 mm, which is a common size used in the industry for low cost. The connector 300 comprises a coaxial connector 310, a first metallic block 350, and a second metallic block 351. The coaxial connector 310 has a characteristic impedance of 50Ω and consists of an outer conductor 311, a dielectric material 322, a mounting wall 320, and a center conductor 330. The space between the outer and center conductors 311, 330 is filled with the dielectric material 322. The dielectric material 322 can be Teflon or any other material. The center conductor 330 is extended from the inside of the coaxial connector 310 to the other side of the mounting wall 320. The two metallic blocks 350, 351 are created by milling properly across a metallic plate with a circular through hole in the center. The first metallic block 350, with a first recess 3502 being a portion of the through hole and located in the middle of a first inner side 3501 of this block as shown in FIG. 3A, is attached to the mounting wall 320. The second metallic block 351, with a second recess 3512 being a different portion of the same through hole and located in the middle of a second inner side 3511 of this block as shown in FIG. 3A, is attached to the mounting wall 320. The first inner side 3501 is separated from the second inner side 3511 by a certain distance and the first recess 3502 is placed face-to-face to the second recess 3512. The extended center conductor 330 of the coaxial connector 310 is placed between the first recess 3502 and the second recess 3512 and located at the center of the original through hole as depicted in FIG. 3B. The coaxial connector 310 is used to connect the coaxial cable. The ground plane of the inserted microstrip line 340 between the first inner side 3501 and the second inner side 3511 is removed. The two via arrays 344 are embedded into the substrate 343 between the first inner side 3501 and the second inner side 3511. The length of the two via arrays 344 does not exceed the thickness of the two metallic blocks 350, 351. The center conductor 330 is in direct contact with the signal line 342 of the microstrip line 340. The outer conductor 311, the mounting wall 320, the first metallic block 350, and the second metallic block 351 are electrically connected to the ground plane 341 of the microstrip line 340.

Figure 4:
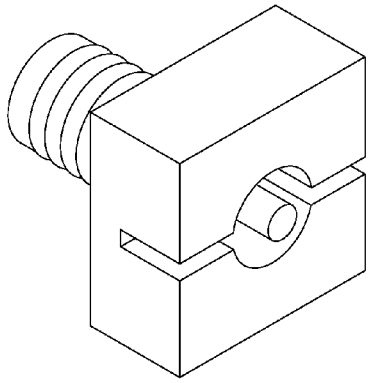
FIG. 4 is the schematic view of another preferred embodiment of the present invention.

With reference to FIG. 4 for the schematic view of another preferred embodiment of the present invention and also to FIGS. 3A and 3B, the mounting wall 320, the first metallic block 350, and the second metallic block 351 can be integrated into one unit to lower its fabrication cost and to simplify its assembly.

In addition to functioning as one type of flange-mount SMA connector, the connector 300 of the present invention can be developed into another type of connector. The coaxial connector 310 of the aforementioned preferred embodiment can be an SMB, SSMA, 1.85 mm, 2.4 mm, 2.9 mm, 3.5 mm, 7 mm, K, N, TNC, or other coaxial connector to improve the frequency responses of the transitions between any of these coaxial connectors and a microstrip line 340 at high frequencies.

The combination of the first recess 3502 of the first metallic block 350, the second recess 3512 of the second metallic block 351, the two via arrays 344 embedded into the substrate 343, and the center conductor 330 constitutes a structure similar to a coaxial cable. The electromagnetic field distribution of the coaxial cable does not vary significantly within this buffer. One of the features of the present invention is the separation of the two metallic blocks 350, 351 by a certain distance and both blocks 350, 351 mounted onto the mounting wall 320. It offers a buffer for the transformation of the electromagnetic field distributions of the two transmission lines at the transition, and thus, improves the transmission characteristics of the transition at high frequencies.

Figure 3C:
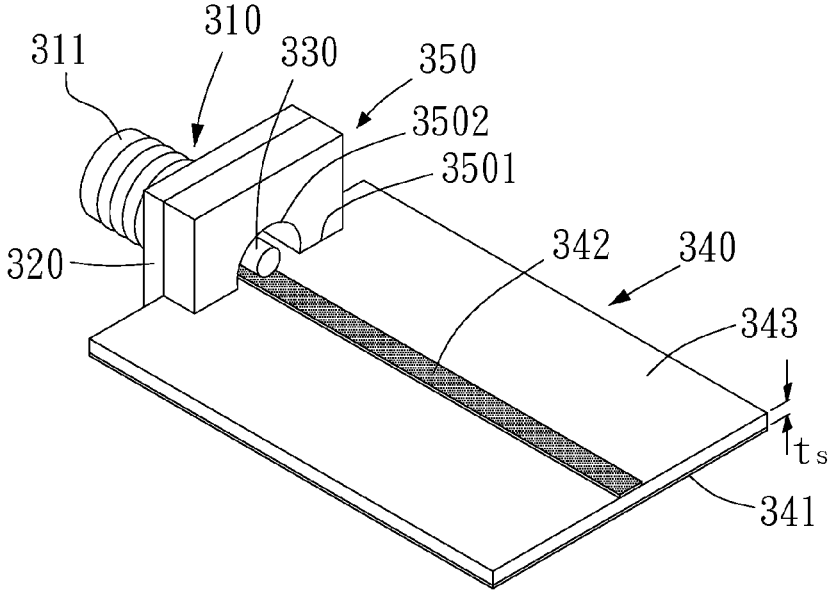
FIG. 3C is the schematic view of a transition between a coaxial cable and a microstrip line using the preferred embodiment of the present invention.
Figure 3D:
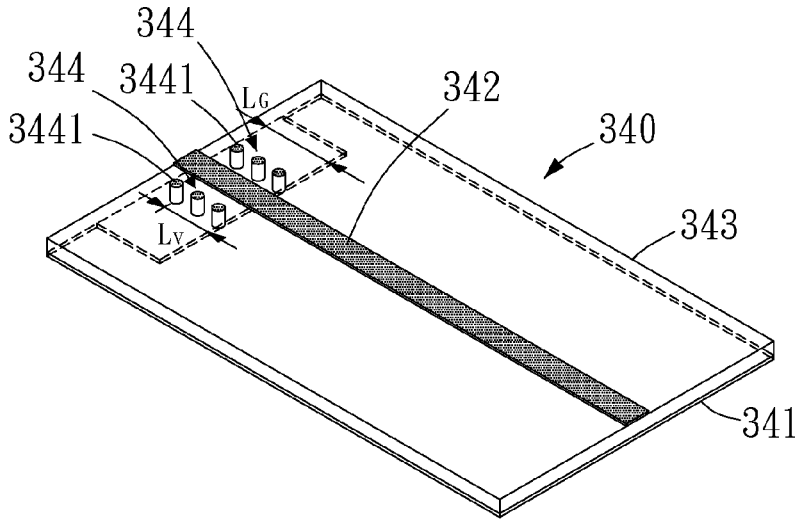
FIG. 3D is the schematic perspective view of a microstrip line for the present invention.

With reference to FIG. 3C, the microstrip line 340 is inserted into the connector 300 between the first metallic block 350 and the second metallic block 351. Both metallic blocks are separated from each other and mounted onto the mounting wall 320. The center conductor 330 is connected to the signal line 342 of the microstrip line 340. The two separated metallic blocks 350, 351 serve as a buffer between the coaxial cable and the microstrip line 340 for the electromagnetic field transformation at the transition. The center conductor 330 can be either in direct contact with the signal line 342 or soldered to it. The difference is insignificant in their frequency responses. The outer conductor 311, the mounting wall 320, the first metallic block 350, and the second metallic block 351 are electrically connected to the ground plane 341 of the microstrip line 340.

By referring to FIG. 3C again, since the two metallic blocks 350, 351 are separated by a certain distance, the microstrip line 340 can be inserted between the first inner side 3501 and the second inner side 3511. However, it is likely that energy leakage to the outside of the connector 300 through the substrate 343 of the microstrip line 340 would happen. Thus, two via arrays 344 are embedded into the substrate 343 of the microstrip line 340 between the two inner sides 3501, 3511 and placed parallel and symmetrical to the signal line 342, and then combined with the two metallic blocks 350, 351 to prevent energy leakage to the outside of the connector 300. The optimum value for the length $L_V$ of the via arrays 344 would be no greater than the thickness $t_M$ of the two metallic blocks 350, 351. The size of the via holes 3441 ranges widely. A diameter of 0.508 mm is chosen for the via holes 3441 of the preferred embodiment, which is also a common practice in the industry for lower fabrication cost. The configuration of the via holes 3441 can be circular, square, rectangular, or any other configuration. Circular via holes 3441 are selected for this preferred embodiment, mainly because they are also the most common practice in the industry for lower fabrication cost. To effectively prevent energy leakage sideward, the density of the via holes 3441 (number of the via holes per unit length) is only required to be greater than a certain value.

It is noteworthy to point out that if the separation between the two metallic blocks 350, 351 is greater than the thickness $t_S$ of the microstrip line 340, energy leakage becomes inevitable through the space between the microstrip line 340 and the first metallic block 350. A solution for this problem is to add solder on the via holes 3441 to increase their heights to prevent energy leakage.

The existence of the via arrays 344 would alter the characteristics of the microstrip line 340 between the two metallic blocks 350, 351, and thus, affect the transmission performance of the transition. A solution for this problem is to remove the ground plane 341 of the microstrip line 340 between the two metallic blocks 350, 351 to achieve a flat passband response. In this preferred embodiment, the length $L_G$ of the removed ground plane 341 is equal to the thickness $t_M$ of the two metallic blocks 350, 351.

Since the two metallic blocks 350, 351 are separated from each other, and the distance between them is equal to the thickness $t_S$ of the microstrip line 340, the portion of the microstrip line 340 with the ground plane 341 removed can be inserted into the space between the two metallic blocks 350, 351. Then, the center conductor 330 is in direct contact with the signal line 342. The electromagnetic field distribution of the coaxial cable would gradually transform into the electromagnetic field distribution of the microstrip line 340 within the region surrounded by the two recesses 3502, 3512 of the two metallic blocks 350, 351 and the two via arrays 344 embedded into the substrate 343. This would reduce the insertion loss caused by the change of the electromagnetic field distributions of the two transmission lines at the transition.

In a preferred embodiment of the present invention, an SMA connector is used; the substrate 343 of the microstrip line 340 has a dielectric constant of 3.38, a thickness $t_S$ of 0.813 mm, and dimensions of 20 mm×30 mm; the first metallic block 350 as well as the second metallic block 351 has a thickness $t_M$ ranging from 1.5 mm to 6 mm, or greater than 6 mm, but preferably equal to 3 mm; the first recess 3502 and the second recess 3512 are different portions of a circular through hole in a metallic plate with a radius $r_M$ ranging from 1.757 mm to 2.307 mm, or greater than 2.307 mm, but preferably equal to 2.057 mm; the outside edges of the first metallic block 350 and the second metallic block 351 are in perfect alignment with the edge of the mounting wall 320; the mounting wall 320 has a square configuration and dimensions of 12.7 mm×12.7 mm; the length $L_T$ of the center conductor 330 extended from the coaxial connector 310 and placed between the first recess 3502 of the first metallic block 350 and the second recess 3512 of the second metallic block 351 can be less than, equal to, or greater than the thickness $t_M$ of the first metallic block 350 and the second metallic block 351, but preferably equal to their thickness $t_M$, 3 mm; the ground plane 341 of the microstrip line 340 inserted into the connector 300 is removed to achieve a flat passband response.

In addition, each of the two via arrays 344 has 2 to 4 via holes 3441 uniformly distributed in the substrate 343 between the first inner side 3501 and the second inner side 3511. The distance between the two via arrays 344 is less than, equal to, or greater than twice the value of the radius $r_M$.

In another preferred embodiment, the length $L_T$ of the center conductor 330 extended from the coaxial connector 310 can be longer, such as 4 mm or more, or shorter, such as 1 mm or less.

Figure 1A:
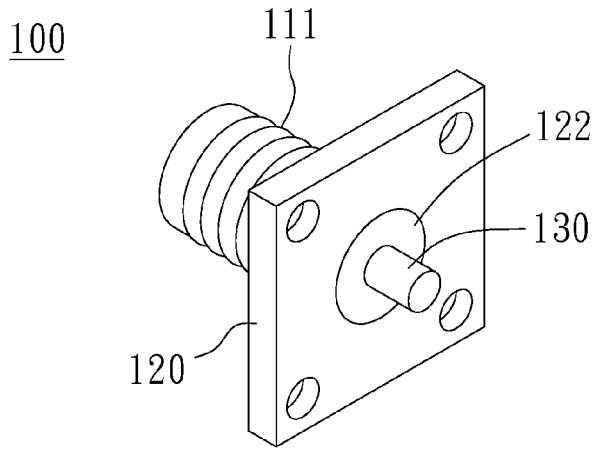
(PRIOR ART) Fig. 1A
FIG. 1A is the schematic view of a conventional flange-mount SMA connector.
Figure 1B:
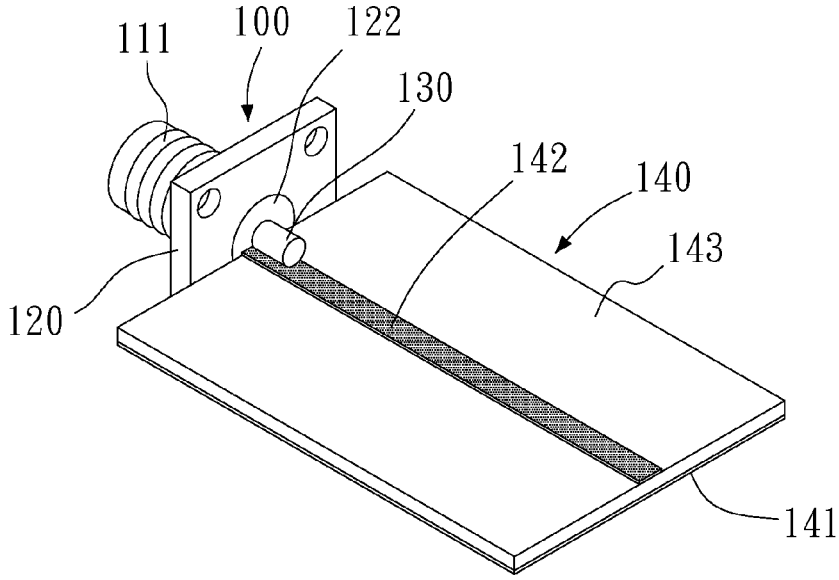
(PRIOR ART) Fig. 1B
FIG. 1B is the schematic view of a transition between a coaxial cable and a microstrip line using a conventional flange-mount SMA connector.
Figure 2A:
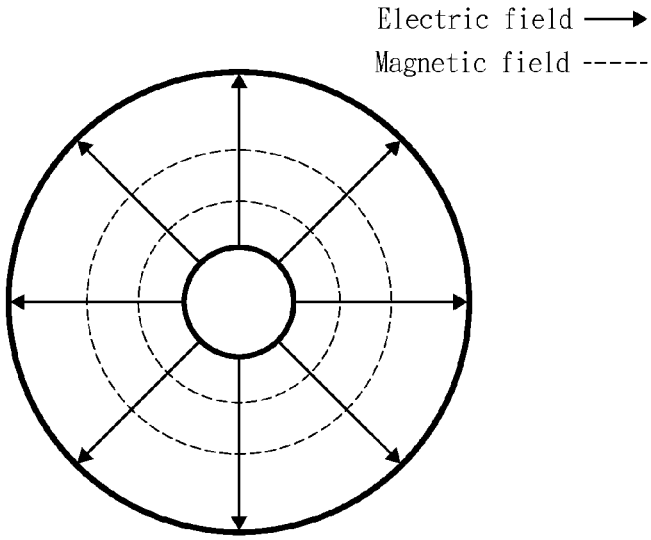
(PRIOR ART) Fig. 2A
FIG. 2A shows the electromagnetic field distribution of a coaxial cable.
Figure 2B:
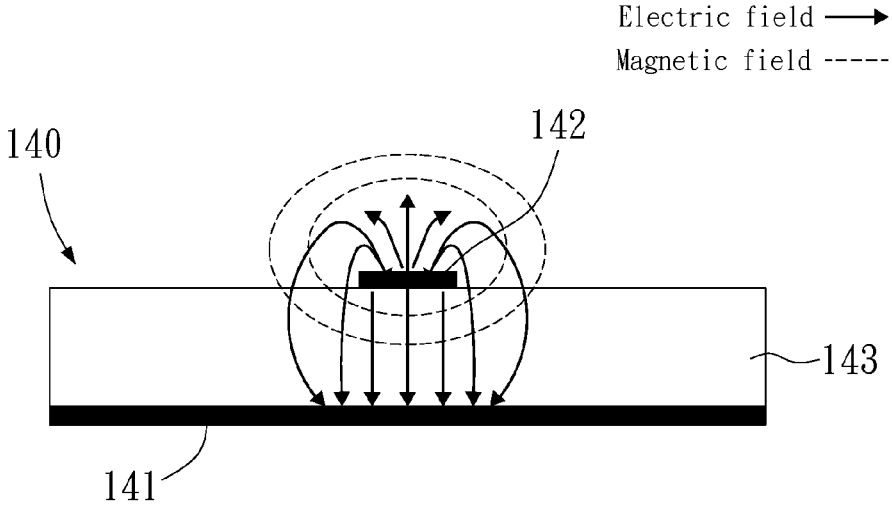
(PRIOR ART) Fig. 2B
FIG. 2B shows the electromagnetic field distribution of a microstrip line.
Figure 5:
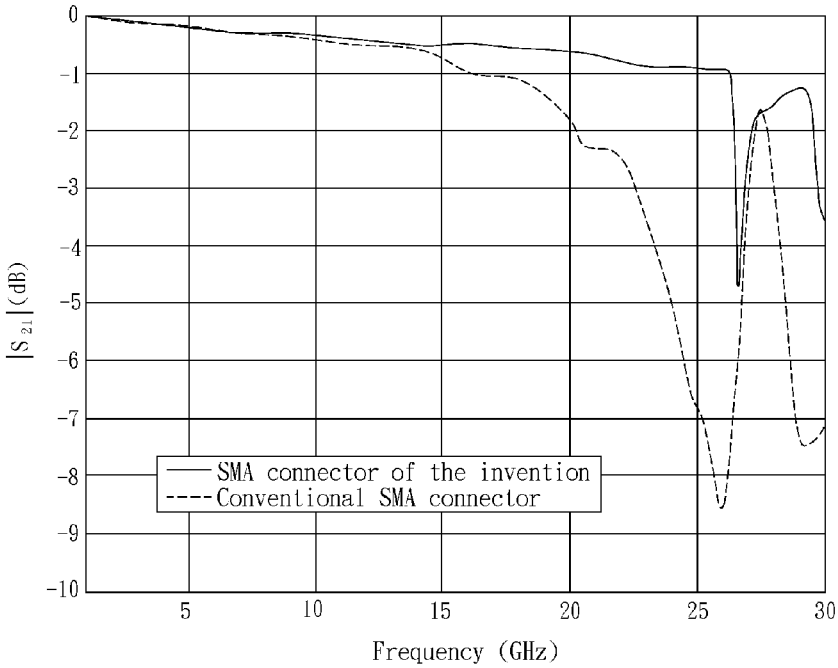
FIG. 5 shows the frequency responses of a transition between a coaxial cable and a microstrip line.

With reference to FIG. 5 for the frequency responses of transitions between coaxial cables and microstrip lines, the frequency responses of a transition between a coaxial cable and a microstrip line using the connector 300 of the present invention (if an SMA connector is employed) shown in FIG. 3A are compared with the frequency responses of a transition using a conventional flange-mount SMA connector 100 shown in FIG. 1A. For the transition using the conventional flange-mount SMA connector 100, the upper limit of its 1-dB passband is 15 GHz. For the transition using the connector 300 of the present invention, the upper limit of its 1-dB passband is 26 GHz. The 1-dB passband of the transition is increased by nearly 73%. Thus, the transmission characteristics of the transition between these two transmission lines are improved significantly at high frequencies.

In another preferred embodiment, the present invention can be applied to a transition to a microstrip line 340 on a substrate 343 of different dielectric constant ($\epsilon_r$=6.15, 10.2, or other values) and different thickness $t_S$ (0.508 mm, 0.305 mm, or other values). All the results indicate that the connector 300 of the present invention (if an SMA connector is employed) can increase the 1-dB passband of a transition between a coaxial cable and a microstrip line 340.

It is noteworthy to point out that for the present invention the radius $r_M$ of the circular through hole, which later turns into the first recess 3502 and the second recess 3512, and the thickness $t_M$ of the first metallic block 350 and the second metallic block 351 are properly selected to achieve the optimum frequency responses of the transition. There are no restrictions on the external sizes and configurations of the first metallic block 350 and the second metallic block 351. However, considering the integration of the first metallic block 350, the second metallic block 351, and the mounting wall 320 into one unit as shown in FIG. 4, their external sizes and configurations are chosen to be in perfect alignment with the square mounting wall 320 to facilitate the mass production of the connector 300 of the present invention.

It is also confirmed that the present invention can be applied to a connector using a different type of coaxial connector, a transition to a microstrip line 340 on a substrate 343 of different dielectric constant and thickness, and a transition to another common planar transmission line, coplanar waveguides. Therefore, the connector of the present invention can be used for signal transmission between a coaxial cable and a planar transmission line with the features of low loss and a wide 1-dB passband.

In summary, the present invention completely meets the three requirements posed by patent applications: innovation, progression, and applicability in the industry. For innovation and progression, the present invention uses two separated metallic blocks 350, 351 of the connector 300, with both having their own recesses 3502, 3512, to serve as a buffer for the electromagnetic field transformation between a coaxial cable and a microstrip line 340 at their transition. Thus, the insertion loss caused by the change of the electromagnetic field distributions of the two transmission lines at their transition is reduced. For applicability in the industry, products originated from the present invention can certainly satisfy the demands from the current market.

The present invention has been described by means of some preferred embodiments. However, those who are familiar with this technique should be aware that these preferred embodiments are used to describe the present invention and should not be used to confine the scope of the present invention. It is noteworthy that modifications and variations made to the preferred embodiments should be covered by the scope of the present invention. The scope of the present invention is set forth in the claims.

What is claimed is:

1. A connector, used for connecting a coaxial cable and a microstrip line with the microstrip line having a signal line, a substrate, and a ground plane, and the signal line on one side of the substrate and the ground plane on the other side of the substrate, wherein the ground plane of the microstrip line inserted into the connector is removed, and two via arrays are embedded into the substrate between a first metallic block and a second metallic block of the connector and placed parallel and symmetrical to the signal line, the connector comprising:

a coaxial connector, including an outer conductor, a dielectric material, a mounting wall, and a center conductor, wherein a space between the outer conductor and the center conductor is filled with the dielectric material, and the center conductor extends from an inside of the coaxial connector to another side of the mounting wall;

the first metallic block, having a first recess being a portion of a circular through hole in a metallic plate and located in a middle of a first inner side of the first metallic block, attached to the mounting wall; and the second metallic block, having a second recess being another portion of the circular through hole and located in a middle of a second inner side of the second metallic block, attached to the mounting wall, and with the first inner side and the second inner side separated by a certain distance and face-to-face oriented, and the extended center conductor placed between the first recess and the second recess;

wherein the coaxial connector is used to connect the coaxial cable, and a portion of the microstrip line with the ground plane removed is inserted between the first inner side and the second inner side, and the two via arrays are embedded into the substrate between the first inner side and the second inner side, and the center conductor is in direct contact with the signal line, and the outer conductor, the mounting wall, the first metallic block, and the second metallic block are electrically connected to the ground plane of the microstrip line;

wherein the two via arrays include a number of via holes evenly distributed in the substrate between the first inner side and the second inner side, and a distance between the two via arrays is at least one of less than, equal to, and greater than twice a value of a radius of the circular through hole.

2. The connector of claim 1, wherein the mounting wall, the first metallic block, and the second metallic block are integrated into one unit.

3. The connector of claim 1, wherein the first recess and the second recess are different portions of the circular through hole in the metallic plate with the radius ranging from 1.757 mm to 2.307 mm, or greater than 2.307 mm.

4. The connector of claim 2, wherein the first recess and the second recess are different portions of the circular through hole in the metallic plate with the radius ranging from 1.757 mm to 2.307 mm, or greater than 2.307 mm.

5. The connector of claim 3, wherein the radius is preferably equal to 2.057 mm.

6. The connector of claim 4, wherein the radius is preferably equal to 2.057 mm.

7. The connector of claim 4, wherein the two via arrays consist of a number of via holes evenly distributed in the substrate between the first inner side and the second inner side, and the distance between the two via arrays is less than, equal to, or greater than twice the value of the radius.

8. The connector of claim 5, wherein the two via arrays consist of a number of via holes evenly distributed in the substrate between the first inner side and the second inner side, and the distance between the two via arrays is less than, equal to, or greater than twice the value of the radius.

9. The connector of claim 6, wherein the two via arrays consist of a number of via holes evenly distributed in the substrate between the first inner side and the second inner side, and the distance between the two via arrays is less than, equal to, or greater than twice the value of the radius.

10. The connector of claim 1, wherein the center conductor is extended from the inside of the coaxial connector to the other side of the mounting wall by a length less than, equal to, or greater than the thickness of the first metallic block and the second metallic block.

11. The connector of claim 2, wherein the center conductor is extended from the inside of the coaxial connector to the other side of the mounting wall by a length less than, equal to, or greater than the thickness of the first metallic block and the second metallic block.

12. The connector of claim 1, wherein the outside edges of the first metallic block and the second metallic block are in perfect alignment with the edge of the square mounting wall.

13. The connector of claim 2, wherein the outside edges of the first metallic block and the second metallic block are in perfect alignment with the edge of the square mounting wall.

14. The connector of claim 1, wherein the first metallic block and the second metallic block have a thickness ranging from 1.5 mm to 6 mm, or greater than 6 mm.

15. The connector of claim 2, wherein the first metallic block and the second metallic block have a thickness ranging from 1.5 mm to 6 mm, or greater than 6 mm.

16. The connector of claim 14, wherein the thickness is preferably equal to 3 mm.

17. The connector of claim 15, wherein the thickness is preferably equal to 3 mm.

18. The connector of claim 1, wherein the coaxial connector is an SMB, SSMA, 1.85 mm, 2.4 mm, 2.9 mm, 3.5 mm, 7 mm, K, N, TNC, or any other coaxial connector.

19. The connector of claim 2, wherein the coaxial connector is an SMB, SSMA, 1.85 mm, 2.4 mm, 2.9 mm, 3.5 mm, 7 mm, K, N, TNC, or any other coaxial connector.

* * * * *